United States Patent [19]

Pedersen et al.

[11] Patent Number: 4,616,645

[45] Date of Patent: Oct. 14, 1986

[54] DIVING REGULATOR WITH ANTI FREE-FLOW VANE

[75] Inventors: Vernon G. Pedersen, Chicago; Michael Martin, Des Plaines, both of Ill.

[73] Assignee: Dacor Corporation, Northfield, Ill.

[21] Appl. No.: 737,497

[22] Filed: May 24, 1985

[51] Int. Cl.[4] ..... A62B 7/04

[52] U.S. Cl. ..... 128/204.26; 128/204.25; 137/494

[58] Field of Search ..... 128/204.18, 204.25, 128/204.26, 204.29; 137/494, 908

[56] References Cited

U.S. PATENT DOCUMENTS 4,010,746 3/1977 Pedersen ..... 128/147
4,140,112 2/1979 Kobzan ..... 128/142.2
4,140,113 2/1979 Pedersen ..... 128/142.2
4,182,323 1/1980 Pedersen ..... 128/204.25
4,446,859 5/1984 Pedersen ..... 137/494 X

*Primary Examiner*—Stephen F. Husar
*Attorney, Agent, or Firm*—Edmond T. Patnaude

[57] ABSTRACT

A demand regulator for use in underwater breathing apparatus employs a vane member dividing the mouthpiece tube into two adjacent air passageways. An interior end of the vane is configured as an air deflector for conducting pressurized air out of the mouthpiece tube substantially through only one of the passageways. The opposite end of the vane is provided with an inclined tab for applying back pressure to the air exiting from the mouthpiece tube, whereby the venturi action of the exiting pressurized air, and consequent free flow tendency of the regulator, are controlled.

8 Claims, 4 Drawing Figures

DIVING REGULATOR WITH ANTI FREE-FLOW VANE

BACKGROUND OF THE INVENTION

1. Field of the Invention

The present invention relates, in general, to the regulation of pressurized air in self-contained underwater apparatus, and it relates more particularly to improving the operation of a second stage demand type regulator which exhibits free flowing characteristics due to the effects of venturi action.

2. Description of the Prior Art

Breathing apparatus of the type used in underwater diving systems commonly employs a two stage regulator arrangement for controlling the flow of air from a pressurized air supply tank. A first stage regulator is generally mounted directly to the air supply tank and is connected it to a second stage regulator by a single length of flexible hose. The second stage regulator usually includes a lightweight housing adapted with a mouthpiece which is capable of being comfortably retained within the mouth of the user. Within the housing is a flexible diaphragm which provides a breathing chamber through which the user inhales and exhales air. The diaphragm is connected to an air inlet valve and, on the side opposite the breathing chamber, it is exposed to ambient pressure such that as the user inhales, the diaphragm collapses toward the breathing chamber, opening the air inlet valve and admitting pressurized air into the breathing chamber. Exhalation of air by the user causes increased pressure within the breathing chamber thereby deflecting the diaphragm outwardly of the breathing chamber and causing the valve to close. A check valve arrangement provided in a wall of the breathing chamber permits air to be exhausted from the regulator as the user continues to exhale.

Regulators of the foregoing type can be designed to perform reliably with relatively few operative components. However, their simplicity belies the difficulties that have been encountered in providing a regulator which operates with minimum breathing effort on the part of the user. One of the characteristics of such regulators is that they tend to free-flow after inhalation by the user has been initiated, causing an air flow condition which does not corespond to the normal breathing requirements of the user. Free-flowing is a condition caused by the venturi effect of the stream of air exiting through the mouthpiece from the breathing chamber resulting in sustained relatively low pressure in the breathing chamber after the user ceases to inhale. The sustained low pressure within the breathing chamber causes the diaphragm to remain collapsed such that the valve continues to admit air into the breathing chamber. While a slight venturi effect is desirable because it enhances the inhalation charateristics of the regulator, extended breathing with a regulator having a tendency to free-flow can be annoying to the user. Moreover, regulator free-flow can be particularly troublesome to the novice or inexperienced diver.

Accordingly, it would be desirable to balance the venturi effect characteristics of a regulator such that venturi action assists the inhalation of air by the user, and yet is easily terminated when the user ceases inhalation. A prior art regulator which recognizes the difficulties associated with balancing venturi effect is disclosed in U.S. Pat. No. 4,182,323 granted Jan. 8, 1980, and assigned to the assignee of the present invention. While such a regulator performs satisfactorily, the need still exists for further refinement of the venturi effect characteristics of regulators, generally.

SUMMARY OF THE INVENTION

An object of the present invention is to provide a new and improved second stage regulator.

Another object of the present invention is to provide such a regulator which is readily manufacturable and reliable in operation.

A further object of the present invention is to provide such a regulator having sufficient free-flowing characteristics to assist the user in inhalation, but which also exhibits minimized free-flowing when inhalation is terminated.

In accomplishing these and other objects, the present invention is directed to a demand regulator including a housing which cooperates with a flexible diaphragm to provide a breathing chamber from which a mouthpiece extends. An inlet valve, connectable to a supply of pressurized air, has an orifice within the breathing chamber for discharging a stream of air in proximity to the mouthpiece tube. The mouthpiece tube is divided into two passageways by a vane having a generally plate-like intermediate portion. An end of the vane extends into the breathing chamber and is turned generally toward the direction of the orifice to deflect air discharged from the orifice into one of the passageways. The vane is further provided with a tab which is disposed with respect to the intermediate portion of the vane such that it projects into the passageway through which the air from the orifice has been directed. Inclination of the tab at an acute angle with respect to the intermediate portion of the vane allows the tab to apply a degree of back pressure to the stream of air flowing through the second passageway without causing the air flow to become turbulent. The venturi effect of the regulator is, thereby, controlled such that it is easily terminated when the user ceases to inhale.

Still another feature of the present invention is the adjustability of the tab with respect to the vane, permitting the user to manually adjust the degree of inclination of the tab for optimum regulator breathing characteristics, without disassembly of the regulator components. Another feature of the present invention is its provision of a unipartite vane member which is readily manufacturable and assembled within a regulator of conventional type.

BRIEF DESCRIPTION OF THE DRAWINGS

The above and other objects and advantages and novel features of the present invention will become apparent from the following detailed description of a preferred embodiment of the invention illustrated in the accompanying drawings wherein.

PREFERRED EMBODIMENTS OF THE INVENTION

Figure 1:
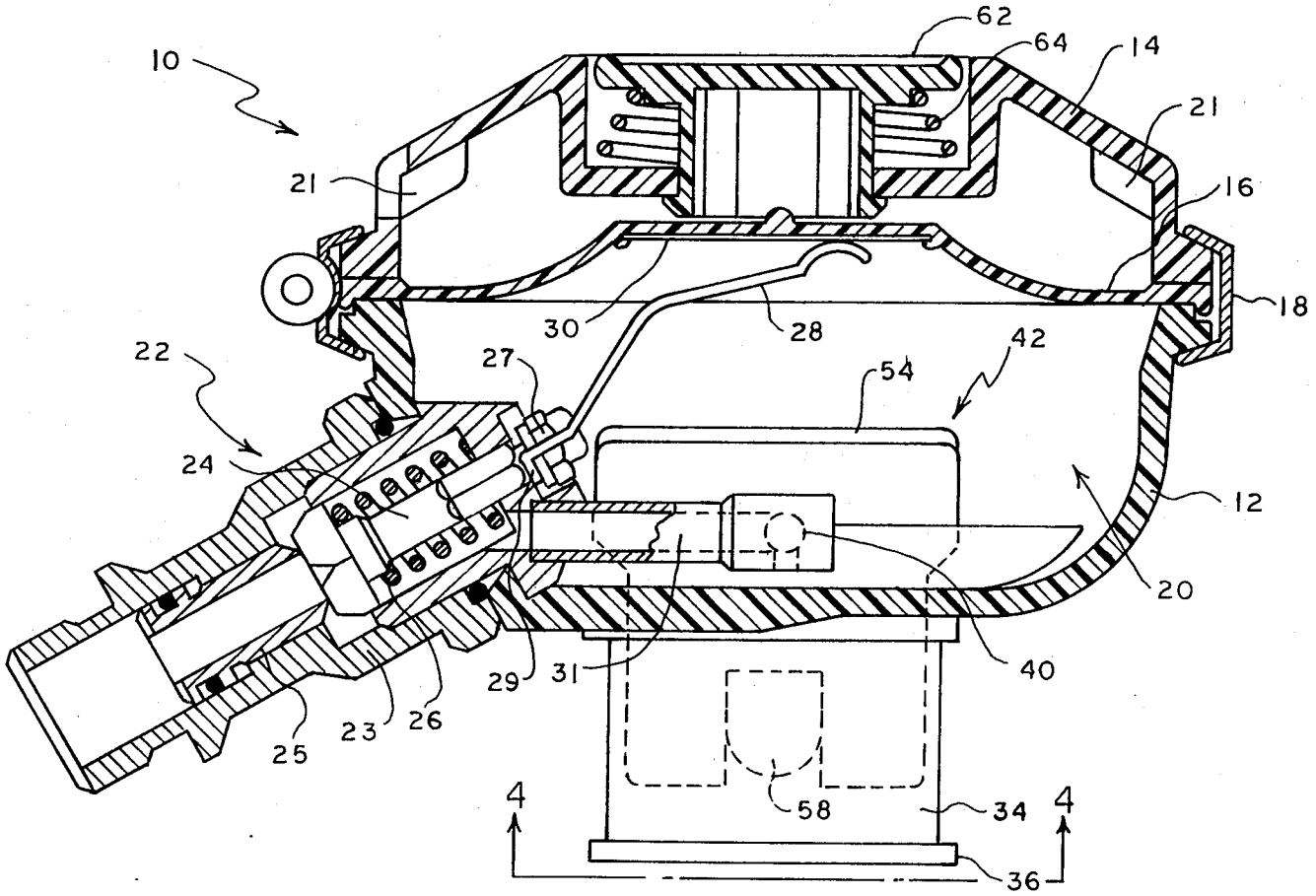
FIG. 1 is a bottom cross-sectional view of a demand regulator embodying the present invention.
Figure 2:
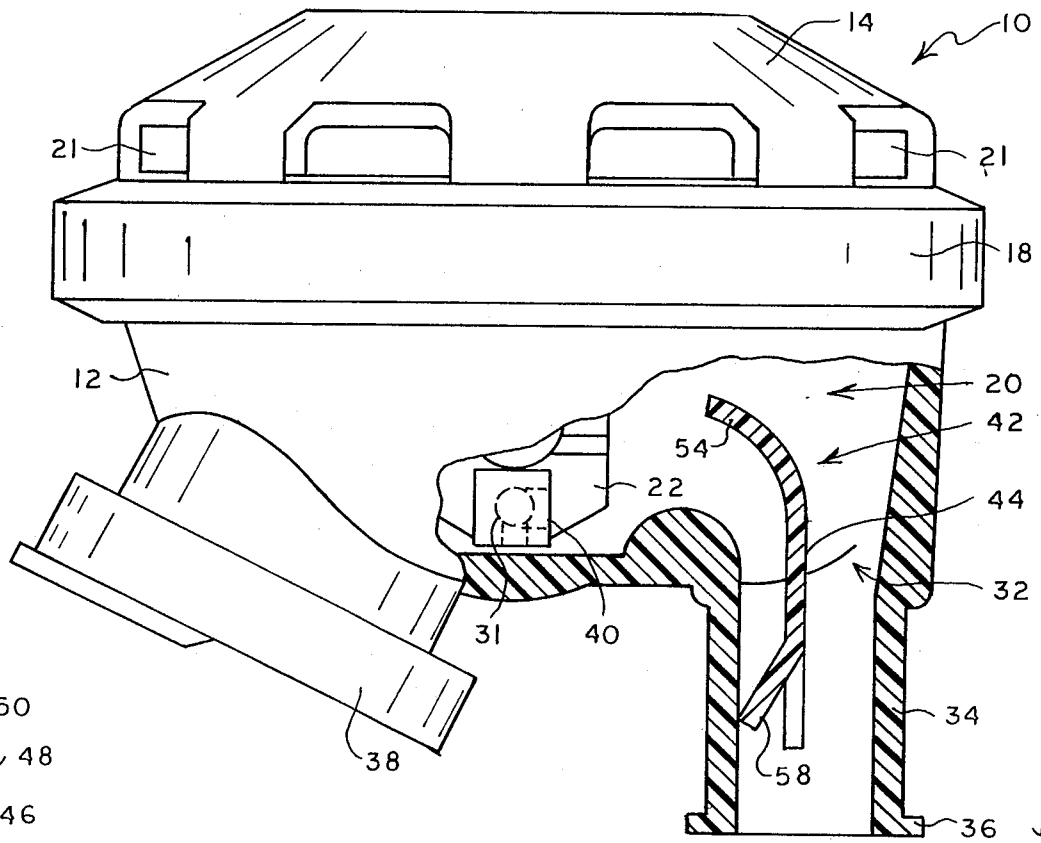
FIG. 2 is a side elevational view, partially in section, of the regulator of FIG. 1.

Referring now to the drawing, and initially to FIGS. 1 and 2, a demand type regulator, designated generally by the reference numeral 10, includes, as its principal parts, a cup-like housing 12 and cover 14, between which is interposed a flexible diaphragm 16. A suitable clamp 18 holds the cover 14 to the housing 12, providing a breathing chamber 20 defined by the sealed cooperation between the diaphragm 16 and housing 12. The cover 14 is provided with a plurality of openings, or ports 21 exposing the side of the diaphragm 16 opposite the breathing chamber 20 to ambient conditions of the regulator environment. A valve 22, which is connectable to a source of pressurized air by means of a flexible hose (not shown), extends into the breathing chamber 20 through an aperture provided in the wall of the housing 12.

Generally, the valve 22 includes a two-piece body 23 which houses a stem 24 and seat 25. The stem 24 is biased against the seat 25 with a coil spring 26 to assume a normally closed position. An end of the stem is threaded to receive a nut 27. The valve 22 is operated by an actuating lever 28 which extends across the breathing chamber 20 such that its distal end is in abutment with the inner face of the diaphragm 16. The opposite end of the lever 28 is forked to provide a pair of tangs 29 for insertion around the threaded end of the stem 24 between the nut 27 and the body 23 of the valve 22. Rotation of the lever 28 in the clockwise direction, as viewed in FIG. 1, causes the tangs 29 to rock against the body 23 and lift the stem 24 away from the seat 25, thereby opening the valve 22. To prevent the premature failure of the diaphragm 16 due to abrasion, the diaphragm 16 is fitted at its inner center portion with a relatively rigid metallic disc 30, providing a bearing surface for the actuating lever 28. Pressurized air is preferably admitted into the breathing chamber 20 through an inlet tube 31 extending from the body of the valve 22.

In order to facilitate breathing through the regulator 10 and as best seen in FIG. 2, the housing 12 is configured with a port 32 from which a mouthpiece tube 34 extends. In a manner well known in the art, the mouthpiece tube 34 is provided with a circumferential flange 36 such that a suitable mouthpiece (not shown) may be attached to the mouthpiece tube 34 for insertion into the mouth of the user. The housing 12 is further adapted with a check valve 38 for permitting air to be exhausted from the breathing chamber 20 as the user exhales into the mouthpiece tube 34.

Figure 3:
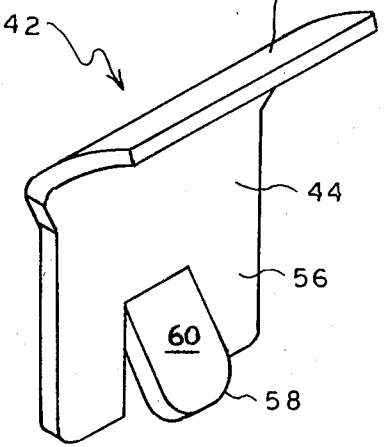
FIG. 3 is a perspective view of a vane member constructed in accordance with the principles of the present invention.
Figure 4:
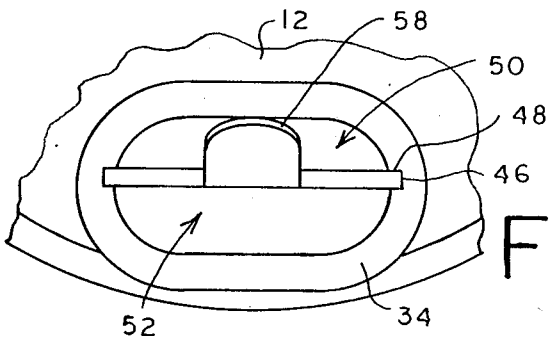
FIG. 4 is a fragmentary view of a mouthpiece tube in accordance with the present invention, taken along the line 4—4 of FIG. 1.

The breathing characteristics of the regulator 10 are, in large part, related to the flow characteristics of the pressurized air admitted into the breathing chamber 20. Preferably, the inlet tube 30 is provided with an orifice 40 in proximity with the outlet port 32 and mouthpiece tube 34. To control the stream of pressurized air discharged from the orifice 40, in accordance with the present invention the regulator 10 is fitted with a vane 42. As best seen in FIGS. 3 and 4, vane 42 is configured with a generally planar intermediate portion 44 such that edges 46 may be received by suitable grooves 48 formed in the wall of the mouthpiece tube 34. The grooves 48 are oriented near the longitudinal center line of the mouthpiece tube 34, so that the vane 42 serves to partition the mouthpiece tube 34 into two passageways 50 and 52. Preferably, the cross-sectional area of passageway 50 is slightly less than the cross-sectional area of passageway 52. An enlarged end portion 54 of the vane 42 extends from the intermediate portion 44 into the breathing chamber 20 and is curved toward the orifice 40 so that pressurized air issuing from the orifice 40 is deflected into passageway 50 of the mouthpiece tube 34. The opposite end 56 of the vane 42 is formed with a centrally positioned tab 58 extending from the intermediate portion 44 and projecting at an acute angle with respect to the intermediate portion 44. The direction in which the tab 58 extends is toward the same side of the vane 42 as the direction in which the curved end portion 54 extends. As best seen in FIG. 4, by this arrangement, a face 60 of the tab 58 is exposed to the flow of air issuing through passageway 50 of the mouthpiece tube such 34.

Considering now the operation of the regulator 10, it will be appreciated that when the user inhales through the mouthpiece tube 34, a pressure differential will be created between the upper or ambient side of the diaphgram 16, as viewed in FIG. 1, and the lower or breathing chamber side of the diaphragm 16. This condition causes the diaphragm 16 to collapse or deflect downwardly into the breathing chamber 20 thereby opening the valve 22 and admitting air into the breathing chamber 20. In a preferred form of the invention, manual actuation of the valve 22 may also be accomplished with a button 62 and coil spring 64 arrangment, whereby the diaphragm 16 may be deflected without inhalation by the user. Once the valve 22 has been opened, a pressurized stream of air issues from the orifice 40 in the general direction of the outlet port 32 and mouthpiece tube 34 whereupon it is deflected by the end portion 54 of the vane 42 such that a preponderance of air exits the mouthpiece 34 through the passageway 50. This flow of air through the breathing chamber 20 and passageway 50 creates a venturi effect and consequential relative low pressure condition within the breathing chamber 20. However, the tab 58 serves to limit the venturi effect by applying back pressure to the air issuing through the passageway 50. When inhalation is terminated, the flow of air through the regulator 10 ceases. As the user exhales into the mouthpiece tube and the pressure within the breathing chamber 20 approaches ambient, the pressure differential across the diaphragm 16 is equalized and the diaphragm 16 assumes its original configuration whereupon the valve 22 is closed. Continued exhalation opens the check valve 38 and exhausted air of the user is thereby discharged from the regulator 10.

We have found that a regulator 10 placed in normal use will have enhanced breathing characteristics if the tab 58 of the vane 42 is approximately one-third the width of the mouthpiece tube 34. Moreover, the tab 58 is preferably inclined at an angle of approximately thirty degrees with respect to the plane of the intermediate portion 44 of the vane 42. This configuration permits a sufficient stream of air to issue through passageway 50 upon demand, while providing a tab surface 60 with sufficient back pressure capability to control the free-flowing tendency of the regulator 10 as the user ceases to inhale. Moreover, the distal end of the tab 58 is preferably rounded to accommodate a more uniform distribution of air flow across the cross section of the passageway 50. Vane 42 may be molded as a unitary piece of relatively rigid plastic, or it may fabricated from a suitable metallic material. In the latter form, the vane 42 can have sufficient resilience such that the tab 58 is adjustable between various degrees of inclination with respect to the intermediate portion 44 of the vane 42. Since the tab 58 is disposed proximate to the opening of the mouthpiece tube 34, the breathing characteristics of the regulator 10 are thereby manually adjustable by insertion of a suitable instrument into the opening of the mouthpiece tube 34.

While only a single embodiment of the present invention has been shown, it will be understood that various changes and modifications may occur to those skilled in the art and it is contemplated by the appended claims to cover all such changes and modifications as fall within the true spirit and scope of the present invention.

What is claimed as new and desired to be secured by Letters Patent of the United States is:

1. A demand regulator for use with underwater breathing apparatus comprising:

a housing, a flexible diaphragm extending across the housing to provide a breathing chamber within said housing, a mouthpiece tube communicating with the breathing chamber through a breathing port provided in a wall of the housing, an inlet valve connected to a supply of pressurized air and having an orifice for discharging a stream of air into said breathing chamber in proximity to said breathing port, a partition wall extending across the mouthpiece tube for dividing the tube into at least two passageways, a first air deflection member extending into said breathing chamber for deflecting the stream of pressurized air from said orifice into a first one of said mouthpiece tube passageways, and a second air deflection member extending partially across said first passageway for applying back pressure to said stream of pressurized air within said first one of said mouthpiece tube passageways.

2. A demand regulator according to claim 1 wherein said first air deflection member comprises an end of said partition wall adapted to extend into said stream of pressurized air.

3. A demand regulator according to claim 1 wherein said second air deflection member comprises a tab formed integrally with said partition wall.

4. A demand regulator according to claim 3 wherein said tab is inclined with respect to said partition wall at an acute angle thereto with a distal end projecting generally outwardly of said mouthpiece tube.

5. A demand regulator according to claim 3 wherein the distal end of said tab is provided with rounded corners.

6. A demand regulator according to claim 4 wherein said tab is adjustable between a plurality of degrees of inclination with respect to said partition wall.

7. A demand regulator according to claim 3 wherein said tab is defined by division of an end of said partition wall into three adjacent segments of substantially equal width with the center segment forming said tab.

8. A demand regulator for use in underwater breathing apparatus, said regulator including a housing; a flexible diaphragm extending across the housing to provide a breathing chamber; a mouthpiece tube extending from the housing and opening into said chamber; an air inlet orifice opening into said chamber; a valve for controlling the flow of air to said orifice; and means connecting said valve to said diaphragm for actuating said valve in response to a pressure differential across opposite sides of the diaphragm; the improvement comprising:

a vane member adapted to be mounted within said mouthpiece tube and having first and second end portions with an intermediate portion therebetween, said intermediate portion comprising a generally plate-like member disposed substantially centrally of said mouthpiece tube to divide said tube into two adjacent passageways, said first end portion extending into said breathing chamber and being inturned toward said inlet orifice to deflect air from said orifice into a first one of said passageways, said second end portion comprising tab means inclined at an acute angle with respect to said intermediate portion and projecting into said first passageway to apply back pressure to the air deflected into the first passageway, whereby a pressure differential across said diaphragm induced by the venturi effect of air discharging from said orifice is reduced when inhalation through the mouthpiece tube is terminated.

* * * * *